US006127315A

United States Patent [19]

Shinozaki et al.

[11] Patent Number: 6,127,315

[45] Date of Patent: Oct. 3, 2000

[54] PRINT MEDIUM AND PRINTING METHOD

[75] Inventors: Kenji Shinozaki; Hideki Hirano; Yukie Otani, all of Kanagawa, Japan

[73] Assignee: Sony Corporation, Tokyo, Japan

[21] Appl. No.: 08/932,967

[22] Filed: Sep. 17, 1997

[30] Foreign Application Priority Data

Sep. 19, 1996 [JP] Japan ..... P08-269439

[51] Int. Cl.[7] ..... B41M 5/035; B41M 5/38

[52] U.S. Cl. ..... 503/227; 428/331

[58] Field of Search ..... 8/471; 428/195, 428/913, 914, 206, 331; 503/227

[56] References Cited

U.S. PATENT DOCUMENTS

| | | | |
|---|---|---|---|
| 4,902,669 | 2/1990 | Matsuda et al. | 503/227 |
| 5,302,576 | 4/1994 | Tokiyoshi et al. | 503/227 |
| 5,444,037 | 8/1995 | Imai et al. | 503/227 |

*Primary Examiner*—Bruce H. Hess
*Attorney, Agent, or Firm*—Hill & Simpson

[57] ABSTRACT

Printing paper is provided which has a mixture layer including inorganic filler and hydrophobic resin formed on a piece of paper as a substrate for making a dye sprayed by vaporization or ablation adhere to the printing paper, and a printing method is provided which forms images on the printing paper by spraying a vaporized dye on the mixture layer without bringing the printing paper and the dye into contact with each other.

17 Claims, 3 Drawing Sheets

PRINT MEDIUM AND PRINTING METHOD

BACKGROUND OF THE INVENTION

The present invention relates to a print medium and a printing method for making recording material such as volatile dye sprayed by vaporization or ablation to adhere to the printing medium, more particularly to a printing paper for a dye vaporization type printer and a dye vaporization type printing method using such printing paper.

In recent years, needs of color printing as well as single color printing has been increasing for hard copies in recording images of video cameras, television sets, and computer graphics.

In response to those needs, hard copying methods such as dye thermal transfer method, wax type thermal transfer method, ink jet method, electrophotographic method, thermal developing silver halide method, etc. have been proposed. Among them, methods for outputting high quality images using a simple apparatus are roughly classified into dye dispersing thermal transfer method (dye sublimative thermal transfer method) and ink jet method.

Among those printing methods, according to the dye dispersing thermal transfer method, which is included in the dye sublimative thermal transfer method, an ink sheet coated with an ink layer comprising a high concentration thermal transfer material dispersed in proper binder resin is brought into close contact at a fixed pressure with a thermal transfer medium such as a piece of photographic paper coated with dye receptive resin that allows a transferred dye to be adhered, then heat corresponding to the image information is applied to the ink sheet by a thermal printing head positioned above the ink sheet. The dye is thus transferred onto the dye receptive layer from the ink sheet according to this heating.

The so-called thermal transfer method, in which the above operation is repeated, for example, for each of the image signals corresponding to the three subtractive primaries, yellow, magenta, and cyan, respectively, is a quick method for getting full-color images and widely noticed as an excellent technique for getting high quality images equal to silver halide color photography.

A thermal printing head (hereinafter referred to as a thermal head) is used for some types of thermal transfer printers. This method, however, has such disadvantages as to produce a large quantity of waste due to disposable ink ribbons (or ink sheets), and require expensive running cost, which prevents this method from spreading. This is also the same in the wax type thermal transfer method.

Furthermore, in full-color printing, a certain color ink once transferred on the printing paper is sometimes transferred back on an ink sheet of different color. This might result in impure printed images due to color mixture of the inks.

Although the thermal developing silver halide method can provide high quality images, the running cost and the apparatus cost are also expensive, since exclusive photographic printing paper and disposable ink ribbons (or ink sheets) are used.

On the other hand, the ink jet method, as disclosed in Unexamined Japanese Patent Applications No. 61-59911 and No. 5-217 carries out printing of images by spraying droplets of liquid dye from nozzles provided on the recording head so as to be adhered on the object printing paper using such methods as the electrostatic attracting force method, the continuous vibration generating method (piezo method), thermal method (bubble jet method), and others selected appropriately according to image information.

Consequently, the method enables image transfer onto normal paper almost without producing waste as is produced in using ink ribbons and the running cost is low. In recent years, the thermal method is becoming popular because the method can output color images easily.

With the ink jet method, however, it is basically difficult to provide density gradation in pixels. Thus, it is difficult to reproduce high quality images equivalent to silver halide photography in a short time as can be obtained by the dye dispersing thermal transfer method.

In other words, since in the related art ink jet printing method, one pixel is formed with one droplet of ink, providing the density gradation in pixels is basically so difficult that it cannot reproduce high quality images. Although the high resolution of the ink jet printing is utilized in the dither method for representing a pseudo gradation, but the same quality as that in the dye thermal transfer method cannot be obtained. Furthermore, the method lowers the image transfer speed significantly.

On the other hand, for the electrophotographic method, the running cost is low and the image transfer speed is high, but the apparatus cost is expensive.

As described above, there has not been any printing method that can satisfy the requirements for image quality, running cost, apparatus cost, image transfer speed, so far.

The inventors have disclosed a method and an apparatus for printing that are proposed to solve the above problems in Unexamined Japanese Patent Application, No. 7-89107. In this prior application heat generated by a heating source heats a dye via a heat medium for supporting the dye (e.g. a light-heat converter comprising carbon particles and binder or comprising a nickel-cobalt alloy thin film and the dye is vaporized or sublimated to be transferred onto the printing paper held with a gap of 1 to 100 $\mu$m between the dye and the printing paper.

In other words, in the method of printing according to the invention of the prior application, a porous structure is formed at the dye heating part of the printer, and the porous structure provides an increased surface area of the heating part (transfer part) that can keep supplying the liquid dye to the heating part and hold the dye there due to the capillarity. And, an amount of heat corresponding to the information for printing is added selectively by a heating means in this state to vaporize part of the liquid dye and transfer an amount of dye onto the printing paper in a form of steam or fine droplets to make a copy according to the information for printing corresponding to the electrical images created by a color video camera.

Consequently, when compared with the well-known ink jet method, this method can form a number of fine liquid droplets and control the number of those droplets freely according to the heating energy applied to the dye liquid heating part corresponding to the information for printing, so that multiple-value density gradation is enabled to obtain printed images (e.g. full-color images) of the quality equivalent to or higher than that of images of the silver halide printing method.

Furthermore, since this printing method adopts vaporization or sublimation of dye, it does not need heating of the dye receptive layer of the print medium as the thermal transfer method in the related art. It is also not needed to press the ink sheet against the print medium strongly nor to use any ink sheet (or ink ribbon). This is also very advantageous to reduce the size and weight of the printer, as well as to reduce the quantity of waste. Furthermore, because the dye layer of the vaporization part is kept separated from printing paper, neither thermal sticking nor color mixture caused by transfer back as mentioned above occurs between them. Furthermore, the printing is possible even when the mutual solubility between dye and dye receptive layer resin is small. Thus, the design and selection of dye and dye receptive layer resin can be carried out with much freedom.

Any dye can be used for this printing method if it has a proper vaporization or ablation speed, exhibits fluidity at 200° C. or under when used independently or mixed with others, and has a necessary and sufficient heat resistance. Specifically, the dye may be a disperse one, an oil-soluble one, a base one, an acid one, and the like. Even if a dye has a melting point above the room temperature, when it is mixed with another dye or a volatile low molecular compound, the mixture provides a lowered melting point.

Any photographic papers can be used for this printing method if it has a proper compatibility with the transferred dye, easily accepts the transferred dye to enhance development of the natural color of the dye, and works to fix the dye. For example, for a disperse dye, a piece of paper whose surface is coated with polyester resin, vinyl chloride resin, acetate resin, or the like that has good compatibility with the disperse dye would be preferable. Fixing of a dye transferred onto photographic paper is possible with a method for heating transferred images to permeate the transferred dye on the surface into the dye receptive layer.

Printing method by this dye vaporization (or ablation) method has the advantage of providing a printer with reduced size, easiness in maintenance, quickness in printing, and performance for producing images with enhanced quality level and enhanced gradation.

However, there has been found no paper suitable for dye vaporization (or ablation) method printers having the above mentioned excellent advantages so far. In other words, if conventional printing paper is used for such a printer, the following problems will arise.

(1) Normal paper (copying paper)

Image transfer is possible for this paper, but much ink runs on the paper, resulting in unclear print images.

(2) Ink jet printing paper

A surface layer with hydrophilic resin as a binder is formed on the paper material, but adhesion of the hydrophobic dye used for the dye vaporization method is poor for this surface layer, resulting in low printed density of printing and poor image retention properties.

(3) Photographic paper for the dye sublimative thermal transfer (thermal head) method Since hydrophobic resin is coated on synthetic paper such as plastic film, etc., the adhesive property of the hydrophobic dye used for the dye vaporization method is satisfactory, and printed images are clear with the high printed density. However, the ink absorption time becomes as long as a few tens of minutes. Furthermore, when images are touched before the ink is absorbed, the images are damaged. Furthermore, since photographic paper is pressed against the thermal head, the paper must have an enough mechanical strength. Consequently, the paper thickness must be increased. The paper is also needed to be heat resistant. The cost of such photographic paper becomes high for those reasons.

Under such circumstances, it is an object of the present invention to provide a print medium such as printing paper, etc. that can make the printing apparatus such as the dye vaporization (or ablation) type printer mentioned above exhibit its excellent characteristics and a printing method using such a print medium.

SUMMARY OF THE INVENTION

In other words, the present invention provides a print medium (e.g. a piece of printing paper: the same applies to the following) comprising a substrate (e.g. a paper substrate: the same applies to the following) and a layer of a mixture formed on the substrate and includes an inorganic filler and a hydrophobic resin.

Furthermore, the present invention provides a printing method comprising the steps of:

preparing a print medium and a dye, the print medium comprising a substrate and a layer of a mixture that is formed on the substrate and includes an inorganic filler and a hydrophobic resin;

arranging the print medium and the dye so that the layer of the mixture formed on the substrate of the print medium and the dye face each other;

spraying the dye by vaporization or ablation; and making the dye to adhere to the layer of the mixture formed on the substrate of the print medium.

According to the print medium and the printing method of the invention, the layer of the mixture including an inorganic filler and a hydrophobic resin is formed on the substrate of the print medium, so the print medium and the printing method of the invention provide the following significant effects.

(I) A hydrophobic printing material like a hydrophobic dye used for printing by the vaporization (or ablation) method exhibits a satisfactory affinity with the hydrophobic resin mentioned above and the dye adhesion is much improved. Consequently, high printed density can be achieved with improved image retention property.

(II) Since inorganic filler is included in the mixture layer mentioned above, adhered printing material can be absorbed by the inorganic filler quickly, and the printing material can be prevented from running. Images, thus, can be fixed enough, so that images are not damaged even when they are touched.

(III) Since the printing is carried out without bringing the printing material into contact with the print medium by vaporizing (or ablating) the printing material to adhere to the print medium, no special photographic paper used for the dye thermal transfer method is needed, so the cost of printing paper can be much reduced.

(IV) The features (size reduction, easiness in maintenance, quickness in printing, enhanced image quality level, enhanced gradation, etc.) of the dye vaporization (or ablation) method can be exhibited effectively by the above features (I), (II), and (III).

The above hydrophobic resin used in the present invention is distinguished clearly from hydrophilic resin. In other words, the term "hydrophilic resin" means a water soluble polymer or a high molecular compound with a crosslinked structure of the polymers at a boiling temperature of water or under. The term "hydrophobic resin", however, means a polymer other than the above defined hydrophilic resin.

DETAILED DESCRIPTION OF THE PREFERRED EMBODIMENTS

Figure 1A:
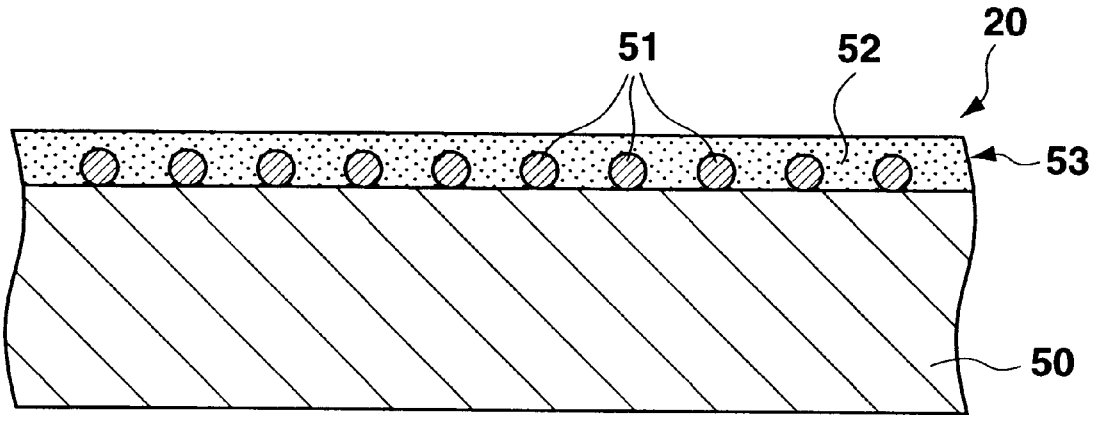
FIG. 1A is a cross sectional view showing an embodiment of a piece of printing paper according to the present invention.

In the print medium and the printing method according to the present invention, the print medium should be a piece of printing paper formed by coating a mixture comprising inorganic filler and hydrophobic resin on a piece of paper or synthetic paper (including plastic film or a mixture comprising paper and plastic) as a substrate. Such a piece of paper or synthetic paper should be smooth as a substrate (base). Thus, synthetic paper would be better for such a substrate.

The inorganic filler is porous preferably with oil absorption of 50 ml/100 g or more (absorption of castor oil: the same applies to the following). More preferably, the oil absorption should be 100 ml/100 g or over. Within this range of oil absorption, hydrophobic printing material is absorbed into inorganic filler satisfactorily, thus running of the printing material will be much reduced. When the oil absorption is 50 ml/100 g or under, amount and rate of absorption of the printing material are apt to be lowered.

The average particle diameter of the inorganic filler (average major diameter of 100 filter particles: the same applies to the following) should be 5 to 6 $\mu$m in terms of absorption and stability of the printing material. If the average particle diameter is 5 $\mu$m or under, the printing material is easily degraded (e.g. degradation from oxidation). Over 6 $\mu$m, absorption of the printing material is easily lowered.

Generally, inorganic filler is preferably white. If, however, the paper base (substrate) is white, the color of the inorganic filler is not limited to be white, but may be another color. Fluorescent pigment added to inorganic filler may also be used.

Inorganic filler is mixed with hydrophobic resin at 5 to 80 weight % of the mixture layer, preferably at 10 to 50 weight %, and more preferably at 20 to 40 weight %. If the content is too low (especially 5 weight % or under) addition of the filler cannot exhibit the above effect. If it is too much (especially, 80 weight % or over), the fraction of the hydrophobic resin becomes so small that the mixture layer sometimes cannot be coated on the substrate. Furthermore, the inorganic filler is easily separated from the mixture layer (especially when a plastic film base is used). If acidic inorganic filler is used, the filler should not be over 50 weight %. Otherwise, the print medium is easily discolored.

Consequently, the ratio of the hydrophobic resin to the inorganic filler is preferably a little more than 1:1 in weight ratio (that is, inorganic filler is less than 50, more preferably 40 weight % of mixture layer). The layer limit of the content is preferably 5 weight %. It would be better with 10 weight % and, with 20 weight %, it would further be better.

The above mixture layer is preferably thinner than the paper substrate with a thickness less than a fraction of the paper substrate thickness, and in an amount of coating, 100 g/m$^2$ or under.

Inorganic filler may comprise at least one selected from a group consisting of amorphous silica, zeolite, alumina, calcium carbonate, and diatomaceous earth.

Among them, amorphous silica contains a silanol group, but it rapidly absorbs the printing material. Other kinds of inorganic filler may be selected properly making the most of their characteristics.

If an inorganic smoother such as kaoline is added to inorganic filler, fuzzing on the surface of the paper substrate (at the boundary of the mixture layer) can be eliminated to provide smoothed surface. If such fuzz exists, adhered printing material runs out easily, but when kaoline is added, this fuzzing can be prevented, so that the surface of the paper substrate is smoothed, reducing running of the printing material.

In other words, it is preferable that a mixture comprising inorganic filler, to which kaoline is added as a smoother, and hydrophobic resin is coated on a substrate surface whose Beck's smoothness is 13 seconds or over and the coated surface is super-calendered to be smoothened.

The above hydrophobic resin may be any one selected from a group consisting of polyester, vinyl chloride resin (including polyvinyl chloride, vinyl chloride—vinyl acetate copolymer), vinylidene chloride resin (polyvinylidene chloride, polyvinylidene fluoride chloride, and the like), polycarbonate, phenoxy resin, and cellulose resin (cellulose acetate butyrate, and the like.). Another resin may also be used if it is soluble with disperse dye and oil-soluble dye.

Those hydrophobic resins can improve adhesion of the dye, printed density, and resistance to weather, and polyester, vinyl chloride resin, polycarbonate, or phenoxy resin is more preferably selected.

To the above hydrophobic resin may be added a plasitcizing agent, for example, tributyl phosphate, tri-2-ehylhexy1 phosphate, tricresyl phosphate, dimethyl phthalate, diethyl phthalate, dibutyl phthalate, or diheptyl phthalate.

Figure 1B:
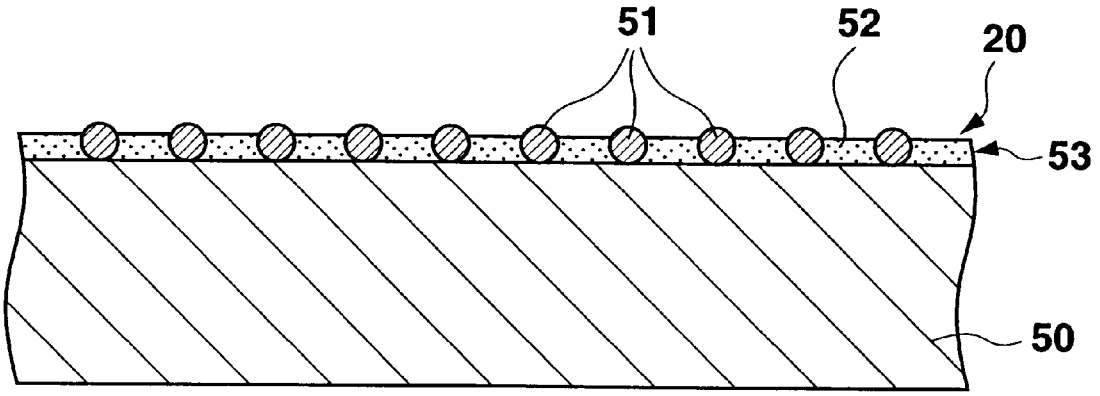
FIG. 1B is a cross sectional view showing another embodiment of a piece of printing paper according to the present invention.

FIGS. 1A and 1B show a printing paper 20 manufactured by coating a mixture layer 43 comprising inorganic filler 51 and hydrophobic resin 52 on one side of a substrate (base) comprising paper or synthetic paper as an embodiment of the print medium according to the present invention.

FIG. 1A shows a case in which inorganic filler 51 is contained in the mixture layer 53 by 50 weight % or under (thus, the content of the hydrophobic resin 52 is 50 weight % or over). This is a desirable case in which the inorganic filler 51 is not exposed from the surface of the hydrophobic resin 52. FIG. 1B shows a case in which inorganic filler 51 is contained in the mixture layer 53 by 50 weight % or over. In this case, inorganic filler 51 is exposed partially from the surface of the hydrophobic resin 52. However, the mixture layer 53 can be used as long as the inorganic filler 51 does not drop off.

In the printing method according to the present invention, a hydrophobic dye, especially, a disperse dye or an oil-soluble dye can be used corresponding to the mixture layer comprising the above inorganic filler and the above hydrophobic resin.

In order to carry out this printing method, a printing head is preferably used which comprises a printing material supplier; a printing material container facing the print medium; a printing material spraying structure to spray the printing material from this printing material container onto the print medium; and a heating means for heating the printing material so as to be sprayed from the printing material container.

Then, the printing material spraying structure is preferably formed with a porous structure (e.g. a group of small cylinders) causing capillarity for drawings up and holding the printing material. A heating element (e.g. a polysilicon layer) used as the heating means for spraying the printing material can be provided in the printing material spraying structure.

Figure 2A:
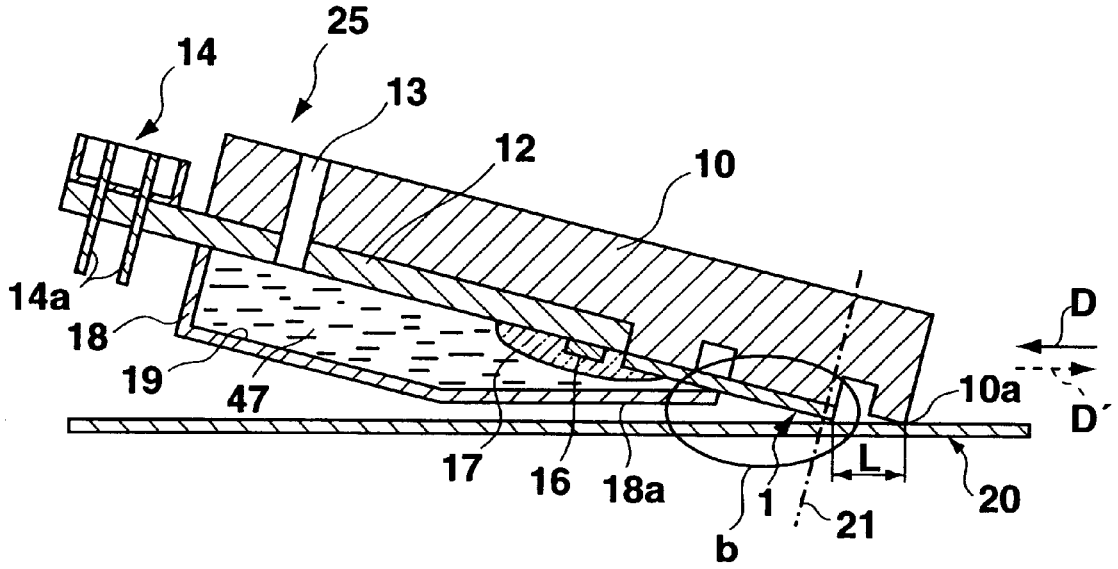
FIG. 2A is a cross sectional view showing an example of a printer head used for printing the printing paper shown in FIGS. 1A and 1B, the cross sectional view being taken on line A—A of later shown FIG. 3.
Figure 2B:
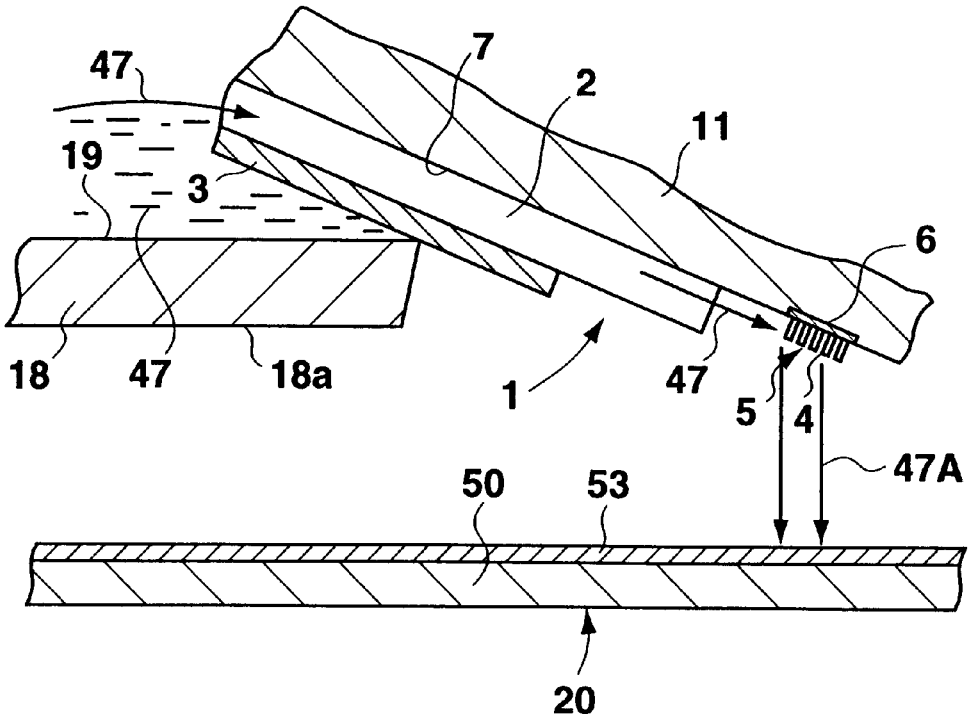
FIG. 2B is an expanded cross sectional view of the encircled portion of FIG. 2A.
Figure 3:
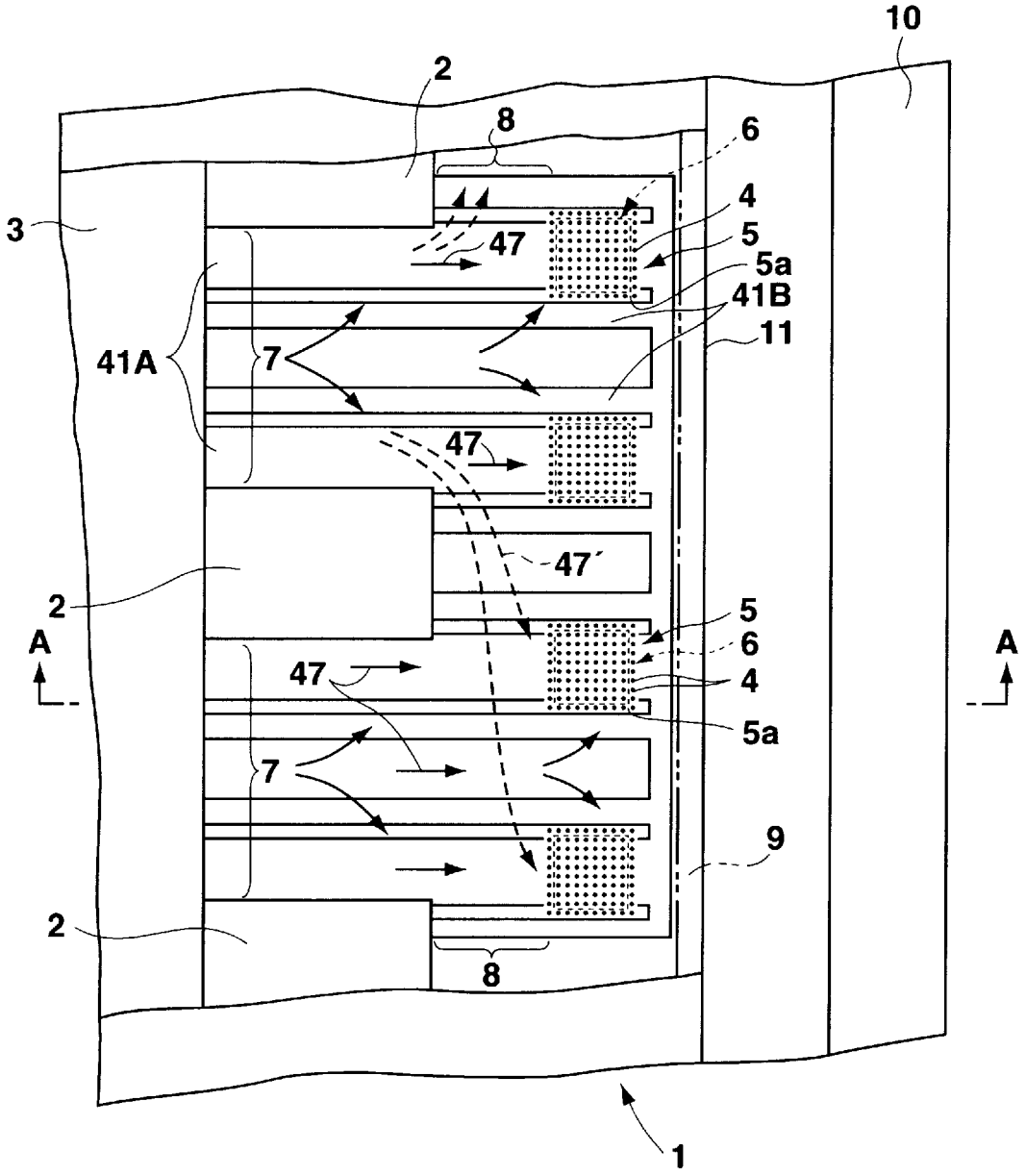
FIG. 3 is a top plan view showing a main portion of the printer head shown in FIGS. 2A and 2B.

FIGS. 2A, 2B and FIG. 3 show a non-contacting dye vaporization (spraying) type printer head 25 in service as an embodiment of a printing head for carrying out the printing method according to the invention.

In this embodiment, the head chip 1 of the printer head is integrally supported by a base plate 10. At the tip of the head chip 1 are provided dye sprayers 5 comprising a group of fine cylinders 4. The dye 47 is supplied from a branched passage 7 partitioned by a branched passage wall 2 to the dye sprayers 5 provided on both sides of the front end of each branched passage 7.

In the dye sprayer 5 is formed a porous structure comprising a group of fine cylinders 4, each of the cylinders is 10 $\mu$m or under (e.g. 1 to 4 $\mu$m) in diameter and 20 $\mu$m or under (e.g. 1 to 10 $\mu$m) in height and formed with, for example $SiO_2$. This group of fine cylinders forms a dye container 5*a* for holding and containing the dye 47 by the capillarity. The dye 47 contained here is heated by a heater 6 to be sprayed out.

The dye 47 is supplied via a plurality of branched passage 7 branched from a common dye feed passages 19. Each branched passage 7 is formed as a slit-like clearance with a branched passage wall 2 comprising a dry film (e.g. sheet resist) whose thickness is 50 $\mu$m or under (e.g. 10 to 30 $\mu$m); a lid 3 comprising a nickel sheet whose thickness is 100 $\mu$m or under (e.g. 20 to 30 $\mu$m); and a substrate 11 comprising silicon whose thickness is 5 mm or under (e.g. 0.2 to 1 mm).

The branched passage wall 2 is provided so that it protrudes up to a middle position between the edge of the lid 3 and a plurality of sprayers 5 (two here). Consequently, the dye 47 is mainly supplied to the dye sprayers 5 arranged on both sides of the front end of each branched passage 7. Then, the area beyond the front end of the branched passage wall 2 is formed as a communicating part 8 so that the dye 47 can flow into every dye sprayer 5 arranged in line via this communicating part 8. To prevent the dye 47 flowing this way from leaking from the substrate 11, is the end of the substrate 11 has applied a fluorocarbon oil-repellent coating 9 as shown with an imaginary line.

As shown in FIG. 2A, the printed-circuit board 12 is provided with a dye inlet 13 penetrating the base plate 10. The liquid dye 47 is fed to the space between the cover 18 and the base plate 10 from the base plate side. The cover 18 is bonded and sealed so as to cover part of the printed-circuit board and part of the head chip 1. Inside this cover 18 is formed a common dye feeding passage 19 for feeding the dye 47 introduced from the dye inlet 13 to each of the above-mentioned branched passages 7.

This cover 18, as shown in FIG. 2A, has a box-like whole shape having such a cross section that the plane facing the printing paper 20 is formed to be an inclined plane 18a according to the service condition. The front edge of the cover 18 is in close contact with the head chip 1, and the face of the cover 18 bonded to the printed-circuit board 12 and the head chip 1 is sealed with a bonding agent to prevent the dye from leaking.

The section around the front edge of the cover 18 is formed as shown in FIG. 2B which is the expanded cross sectional view of the encircled part b of FIG. 2A. In other words, the dye 47 fed from the common dye feeding passage 19 is distributed to each branched passage 7, the slit-like fine space formed on the substrate 11 of the head chip 1, by the branched passage wall 2 and the lid 3, and is led as shown by the arrow. Then, due to the capillarity, the dye 47 is absorbed into the dye container 5 comprising a group of fine cylinders as shown with the arrow in FIG. 2B (the cross sectional view taken on line A—A of FIG. 3), then contained and held in it.

Thus formed the printing head 25, by bringing one end 10*a* of the base plate 10 on the side provided with the head chip 1 into contact with the printing paper 20, can be positioned so that the gap between the center 21 of the dye sprayer 5 (center of the heater 6) and the printing paper 20 can be kept at a fixed distance, while keeping a specified angle against the printing paper 20.

The solid line arrow D in FIG. 2A shows the scanning direction of the printer head 25 in printing and the broken line arrow D' shows the returning direction of the printer head 25 after printing. Consequently, in printing, the heater 6 is actuated with a signal corresponding to the image data transmitted via a connector 14 provided at the other end of the printed-circuit board 12, the dye 47 from the dye sprayer 5 is vaporized so that the vaporized dye 47A in FIG. 2B is sprayed onto the printing paper 20. The wiring on the printed-circuit board 12 is connected to an FPC (Flexible Print Circuit; not illustrated here) via the connector 14.

In this printer head 25, the dye 47 is fed to two dye sprayers 5 and 5 concurrently through the branched passages 7 as described above, so there is no need to narrow the gap between the printing material supply passages 7—7 even when the gap between the dye sprayers 5—5 is narrowed corresponding to the enhanced resolution of the printed image. Thus, the dye 47 can be fed sufficiently. Furthermore, manufacturing of the apparatus does not become complicated. In the manufacturing process for forming the branched passage 7, a high accuracy is not required, so the manufacturing yield of the apparatus becomes higher than the related art method to make the manufacturing cost low.

Since the branched passage wall 2 is projected up to a mid-position between the lid 3 and the dye sprayer 5 and the communicating part 8 is formed in an area where no branched passage wall 2 exists. Thus, each branched passage 7 can also feed the dye 47 to the dye sprayers 5 in areas other than the normal area to which mainly each branched passage 7 feeds the dye 47 (that is, to the dye sprayers on the sides of adjacent branched passages). Consequently, the cross sectional area of each branched passage 7 is independent of the interval of the dye sprayers 5, so printing material can be fed sufficiently to the dye sprayer 5 even when the interval of the dye sprayers 5 is narrowed.

In FIG. 3, the solid line arrow 47 shows the flow of the dye 47 to the normal feed area of the branched passage 7. The broken line arrow 47' shows exemplified flows of the dye 47 to areas other than the normal dye feed area. Consequently, for example, even when the dye 47 is not fed from the specified branched passage 7 for any reason, the dye 47 is fed from another branched passage 7 along a flow shown by the arrow 47', so that printing is carried out without any problem.

For example, even when no group of fine cylinders exists in the dye sprayer 5, the printing material can be sprayed. In such a case, a current flows to the specified individual electrodes 41A and to the common electrode 41B via the polysilicon layer according to image information, so that the polysilicon heater 6 arranged under the dye sprayer 5 is heated to vaporize and spray the dye 47 existing above the heater 6. However, the existence of a dye spraying structure comprising a group of fine cylinders 4 enables the dye 47 to be held in the dye sprayer 5 more satisfactorily due to the capillarity when the surface tension of the dye 47 is lowered by heating. Thus, the dye 47 can be better sprayed.

Evaluation of the print medium according to the present invention was carried out with several printing paper examples in comparison with printing paper examples of the related art.

Printing Paper Example 1:

A piece of normal high quality paper (basis weight: 65 g/m$^2$) with 35 seconds of sizing content based on JIS P8122 was used as a substrate. Silica (trade name "Mizukasil P527" from Mizusawa Kagaku Co., Ltd.) as an inorganic filler and polycarbonate (trade name "Ubilon S-3000" from Mitsubishi Engineering Plastic Corp. as a binder were used to prepare a coating composition comprising the following components.

| | |
|---|---|
| Silica (oil absorption: 120 ml/100 g, average grain diameter: 6 $\mu$m) | 100 parts by weight |
| Polycarbonate | 200 parts by weight |
| Cyclohexanone | 800 parts by weight |

This composition was coated on the substrate with a dry coating amount of 15 g/m$^2$ using the blade coater method. Then, the compound was dried with a normal method to be manufactured as the printing paper example 1.

Printing Paper Example 2:

The printing paper example 2 was manufactured in the same way as for the above printing paper example 1 except that polyester (viron resin from TOYOBO Co., Ltd.: glass transition point Tg of about 50° C.) was used as a binder and a mixed solvent comprising methyl ethyl ketone and toluene with a ratio of 1:1 was used as a solvent.

Printing Paper Example 3:

A coating composition was prepared with calcium carbonate (trade name "Univer 70" from Shiraishi Kogyo Co., Ltd.) as an inorganic filler and the same polycarbonate as was used for the printing paper example 1 as a binder according to the following composition.

| | |
|---|---|
| Calcium carbonate (Oil absorption: 100 ml/100 g, average grain diameter: 5 $\mu$m) | 100 parts by weight |
| Polycarbonate | 200 parts by weight |
| Cyclohexanone | 800 parts by weight |

This composition was coated on the substrate mentioned above with a dry coating amount of 15 g/m$^2$ using the blade coater method, then dried with a normal method to manufacture the printing paper example 3.

Printing Paper Example 4:

The printing paper example 4 was manufactured in the same way as for the printing paper example 1 except that a piece of synthetic paper (trade name "YUPO" from Oji Seishi Co., Ltd.) was used as a substrate.

Printing Paper Example 5:

A piece of normal high quality paper (basis weight: 55 g/m$^2$) with Beck's smoothness (JIS standard) of 20 seconds was used as a substrate. Silica (trade name "Mizukasil P527" from Mizusawa Kagaku Co., Ltd.) as an inorganic filler and polycarbonate (trade name "Ubilon S-3000" from Mitsubishi Engineering Plastic Corp.) as a binder were used to prepare the coating composition comprising the following components.

| | |
|---|---|
| Kaoline | 65 parts by weight |
| Calcium carbonate (the same as for the printing paper example 3) | 35 parts by weight |
| Polycarbonate (the same as that for the example 1) | 200 parts by weight |
| Cyclohexanone | 800 parts by weight |

This composition was coated on the substrate mentioned above with a dry coating amount of 15 g/m$^2$ using the blade coater method, then dried with a normal method. After this, the composition was supercalendered to be manufacture as the printing paper example 5 with smooth surface.

Comparing Examples 1 and 2:

As a comparing example 1, a piece of printing paper for dye sublimative thermal transfer printers (trade name "VMP-90STA" from SONY CORP.) was used. As a comparing example 2, a piece of copying paper available in markets (from NBS RICOH CO., LTD.) was used.

The evaluation of the printing paper examples described above was made by evaluating the same printed color image formed on each of the printing paper examples with the dye vaporization method shown in FIGS. 2A, 2B and FIG. 3 using an ink comprising the following components.

| | |
|---|---|
| Yellow ink (composition); | |
| Solvent yellow 56 | 20 parts by weight |
| Dibutyl phthalate | 80 parts by weight |
| Magenta ink (composition) | |
| Disperse red 60 | 20 parts by weight |
| Dibutyl phthalate | 80 parts by weight |
| Cyan ink (composition) | |
| Solvent blue 35 | 15 parts by weight |
| Dibutyl phthalate | 85 parts by weight |

The printed image evaluation was carried out on the following basis. Table 1 shows the results of the evaluation.

1) The dot printed density was obtained by measuring the transmissivity of the printed dots using a microspectrophotometer (from Hitachi, Ltd.).

2) Dot shape was evaluated by observing the printed dots with a stereoscopic microscope with almost circular dots marked with ○, slightly damaged circular dots with Δ, and indeterminate shape dots with x.

3) The degree of ink running is indicated by a ratio of the diameter of dots measured with a stereoscopic microscope immediately after printing to the diameter equivalent to 300 DPI (about 80 microns).

4) The color definition is classified into 4 ranks marked as ◎, ○, Δ, and x, with "the best" was marked with ◎ and "the worst" with x.

5) The absorption speed is defined as a time required until no stain occurs on the printing paper even when rubbed by a finger.

TABLE 1

| | Printing Paper Example 1 | Printing Paper Example 2 | Printing Paper Example 3 | Printing Paper Example 4 |
|---|---|---|---|---|
| Inorganic filler | Silica | Silica | Calcium carbonate | Silica |
| Binder | Poly-carbonate | Polyester | Poly-carbonate | Poly-carbonate |
| Substrate | High quality paper | High quality paper | High quality paper | Synthetic paper |
| Dot printed density (magenta) | 1.8 | 1.6 | 1.4 | 1.8 |
| Dot shape (magenta) | ○ | ○ | ○ | ○ |
| Degree of ink running (magenta) | 1.2 | 1.2 | 1.2 | 1.1 |
| Tint (yellow) | ◎ | ◎ | ○ | ◎ |
| Tint (magenta) | ◎ | ◎ | ○ | ◎ |
| Tint (cyan) | ○ | ○ | ○ | ○ |
| Ink absorption speed (magenta) | 0 | 0 | 0 | 0 |

| | Printing Paper Example 5 | Comparing Example 1 | Comparing Example 2 |
|---|---|---|---|
| Inorganic filler | Calcium carbonate Kaoline | — | — |
| Binder | Poly-carbonate | Hydrophobic resin | — |
| Substrate | High quality paper | Synthetic paper | High quality paper |
| Dot printed density (magenta) | 1.9 | 1.8 | 0.8 |
| Dot shape (magenta) | ○ | ○ | ○ |
| Degree of ink running (magenta) | 1.2 | 1.2 | 2.3 |
| Tint (yellow) | ◎ | ◎ | Δ |
| Tint (magenta) | ◎ | ◎ | x |
| Tint (cyan) | ○ | ○ | x |
| Ink absorption speed (magenta) | 0 | 35 min. | 0 |

It is found from this result that when the printing paper examples 1 to 5 according to the invention are used to form color images thereon with the dye vaporization method, the dot printed density and the dot shape are improved more than those in the comparing examples. Therefore, running of ink in printed images is much reduced and the tint is improved significantly. Furthermore, the ink is absorbed in the substrate immediately. Thus, even performance item is found to be satisfactory. When ink jet printing paper was used as a printing paper, however, the dot printed density was low and the image retention property was poor.

In the printing paper examples 1 to 4 according to the invention, it is found that the ink absorption is improved and the image is printed with high printed density when silica is used as inorganic filler and polycarbonate is used as a binder. If kaoline is added to the inorganic filler, the above characteristics is improved equally or more than that in the printing paper example 1 as understood from the printing paper example 5. And it is found that the performance is much more improved than that in the printing paper example 3. The degree of ink running shown above increases slightly with time, but in the printing paper example 5 in which kaoline is added to the inorganic filler, it is confirmed that the degree of ink running does not increase so much even with elapse of time.

The embodiments according to the present invention are as described above, but they can be modified on the basis of technical spirit and scope of the invention.

For example, the material and thickness of components of the above mentioned printing paper may be changed. Especially, the type, mixing ratio, etc. of the inorganic filler and the hydrophobic resin may be variously changed. The mixture comprising inorganic filler and hydrophobic resin can also be coated with any other method such as the wire bar method and the roll coater method.

The structure and shape of the printer head mentioned above may be modified as needed and the material of every part of the printer head may also be changed as needed. In addition to the cylinder-like structure, the porous structure provided in the vaporization part may be formed with any other structure such as walls, an assembly of beads, and fibers. The material and shape of the heating element may be modified. Depending on the situation, the resistance heating may be replaced with laser heating. The printing dyes, in addition to those for full-color printing with three colors of magenta, yellow, and cyanogen (furthermore, with black added), may be provided for carrying out two-color, single-color, or monochrome printing.

Not only the dye vaporization method, but also the ablation type may be employed for the thermal transfer printing according to the invention. In any methods, dyes or printing materials are sprayed to be transferred properly.

What is claimed is:

1. A print medium for a dye vaporization type printer, comprising:

a substrate;

a layer of a mixture formed on said substrate, said mixture including an inorganic filler and a hydrophobic resin said layer of said mixture absorbing a dye sprayed by vaporization for making said dye to adhere to said layer, said inorganic filler being particles with an average diameter ranging from 5 $\mu$m to 6 $\mu$m, said inorganic filler having an inorganic smoothing agent added thereto to smooth a surface of said substrate, said inorganic smoothing agent being kaoline, and said layer of said mixture being coated on said substrate wherein said substrate has a Beck's smoothness of 18 seconds or over.

2. A print medium as defined in claim 1, wherein said substrate is one of a piece of paper and a piece of synthetic paper with said layer of said mixture being coated thereon.

3. A print medium as defined in claim 1, wherein said inorganic filler is porous with oil absorption of 50 ml/100 g or more.

4. A print medium as defined in claim 1, wherein said inorganic filler included in said mixture occupies 5 to 80 weight %.

5. A print medium as defined in claim 1, wherein said inorganic filler included in said mixture occupies 10 to 50 weight %.

6. A print medium as defined in claim 1, wherein said inorganic filler comprises at least one selected from a group consisting of amorphous silica, zeolite, alumina, calcium carbonate, and diatomaceous earth.

7. A printing medium as defined in claim 1, wherein said hydrophobic resin comprises at least one selected from a group consisting of polyester, vinyl chloride resin, vinylidene chloride resin, polycarbonate, phenoxy resin, and cellulose resin.

8. A printing method, comprising the steps of:

preparing a print medium and a dye, said print medium comprising a substrate and a layer of a mixture formed on said substrate, said mixture including an inorganic filler and a hydrophobic resin said inorganic filler being particles with an average diameter ranging from of 5

μm to 6 μm, and said inorganic filler having an inorganic smoothing agent added thereto to smooth the surface of said substrate;

arranging said print medium and said dye so that said layer of said mixture formed on said substrate of said print medium and said dye face each other;

spraying said dye by vaporization; and making said dye to adhere to said layer of said mixture formed on said substrate of said print medium.

9. A printing method as defined in claim 8, wherein said print medium has a substrate comprising one of a piece of paper and a piece of synthetic paper with said layer of said mixture being coated thereon.

10. A printing method as defined in claim 8, wherein said inorganic filler is porous with oil absorption of 50 ml/100 g or more.

11. A printing method as defined in claim 8, wherein said inorganic filler included in said mixture occupies 5 to 80 weight %.

12. A printing method as defined in claim 11, wherein said inorganic filler included in said mixture occupies 10 to 50 weight %.

13. A printing method as defined in claim 8, wherein said inorganic filler comprises at least one selected from a group consisting of amorphous silica, zeolite, alumina, calcium carbonate, and diatomaceous earth.

14. A printing method as defined in claim 8, wherein said inorganic smoothing agent is kaoline, said layer of said mixture is coated on said substrate whose Beck's smoothness is 18 seconds or over, and the surface of said substrate is smoothed by calendering.

15. A printing method as defined in claim 8, wherein said hydrophobic resin comprises at least one selected from a group consisting of polyester, vinyl chloride resin, vinylidene chloride resin, polycarbonate, phenoxy resin, and cellulose resin.

16. A printing method as defined in claim 8, wherein said dye is a hydrophobic dye.

17. A printing method as defined in claim 16, wherein said hydrophobic dye comprises one of a disperse dye and oil-soluble dye.

* * * * *